US006359954B1

(12) United States Patent
Maeder

(10) Patent No.: US 6,359,954 B1
(45) Date of Patent: Mar. 19, 2002

(54) DEVICE FOR COUNTING PRODUCTS CONVEYED AS AN OVERLAPPING ARRANGEMENT

(75) Inventor: Carl Conrad Maeder, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/582,128

(22) PCT Filed: Dec. 29, 1998

(86) PCT No.: PCT/CH98/00560

§ 371 Date: Jun. 22, 2000

§ 102(e) Date: Jun. 22, 2000

(87) PCT Pub. No.: WO99/35614

PCT Pub. Date: Jul. 15, 1999

(30) Foreign Application Priority Data

Dec. 30, 1997 (CH) ..... 2985/97

(51) Int. Cl.[7] ..... G06M 11/00
(52) U.S. Cl. ..... 377/8
(58) Field of Search ..... 377/8

(56) References Cited

U.S. PATENT DOCUMENTS

| | | | | |
|---|---|---|---|---|
| 4,504,961 A | * | 3/1985 | Horiguchi | 377/8 |
| 4,652,197 A | * | 3/1987 | Littleton | 414/50 |
| 4,713,831 A | | 12/1987 | Morisod | |
| 5,084,906 A | | 1/1992 | Reist | |
| 5,324,921 A | * | 6/1994 | Takarada et al. | 235/98 R |

FOREIGN PATENT DOCUMENTS

| | | |
|---|---|---|
| EP | 408490 | 1/1991 |
| GB | 2165676 | 4/1986 |

* cited by examiner

*Primary Examiner*—Margaret R. Wambach
(74) *Attorney, Agent, or Firm*—Alston & Bird LLP

(57) ABSTRACT

An apparatus for counting flexible flat objects, such as printed products, which are conveyed in an overlapping formation. A detection device counts the objects as they are being conveyed, and comprises an insertion element which is moved in the direction of conveyance at a speed greater than the conveying speed of the objects so as to catch up with an object and interact with an end section of the object, and a detection element which emits a signal to a counter when the insertion element interacts with an end section of an object.

8 Claims, 2 Drawing Sheets

DEVICE FOR COUNTING PRODUCTS CONVEYED AS AN OVERLAPPING ARRANGEMENT

BACKGROUND OF THE INVENTION

The present invention relates to an apparatus for counting flexible flat products arranged in an overlapping formation, especially printed products.

An apparatus of this type is disclosed by EP-A-0 408 490. A conveying device, constructed as a belt conveyor and driven at a conveying speed in a conveying direction, is intended to convey printed products arranged in a regular overlapping formation, in which each printed product rests on the preceding one, past a detection device. The latter has a slide which is driven alternatingly in and counter to the conveying direction by means of a drive, matched to a system cycle rate at which the printed products are conveyed, and on which a contact element is arranged. If the slide is moved in the conveying direction at a speed which is higher than the conveying speed, when the contact element catches up with an object it comes into contact with the rear edge of the latter. Because of the higher speed of the slide in relation to the conveying speed, the contact element is deflected mechanically by a force directed counter to the conveying direction. This deflection of the contact element is registered by means of a detection means likewise arranged on the slide, a signal being emitted to a counter. This known apparatus is not really suitable for counting thin objects. In addition, in order to deflect the contact element a certain force is needed which, in particular in the case of thin objects, could damage the rear edge. If no specific measures are taken, there is also the risk that the objects can be displaced because of the action of the contact element.

It is an object of the present invention to provide a generic apparatus which is suitable for the precise counting even of thin objects.

SUMMARY OF THE INVENTION

The above and other objects and advantages of the present invention are achieved by the provision of an apparatus which comprises a conveying device for conveying the objects in an overlapping formation, and a detection device which includes an activation element which is moved cyclically during at least a portion of its movement path in the conveying direction and at a speed higher than the conveying speed, so as to be brought into interaction with a rear region of each object conveyed past the detection device. The detection device further includes a detection element which emits a signal to a counter when the activation element interacts with the respective object.

The activation element is constructed as an insertion element which is inserted into the rear end region of the respective object or between the object and the following object. The insertion element and the detection element create a counting barrier for each object. The same effect is achieved as if the objects were conveyed individually through the counting barrier, although they are conveyed in an overlapping formation. The objects to be counted trigger the generation of the signal themselves directly because of their presence in the counting barrier between the insertion element and the detection element. As a result, the action of force on the rear edge of the objects can be avoided, or at least can be kept extremely small.

BRIEF DESCRIPTION OF THE DRAWINGS

The invention will now be described in more detail using embodiments illustrated in the drawing, in which, in purely schematic form.

DETAILED DESCRIPTION OF THE PREFERRED EMBODIMENTS

Figure 1:
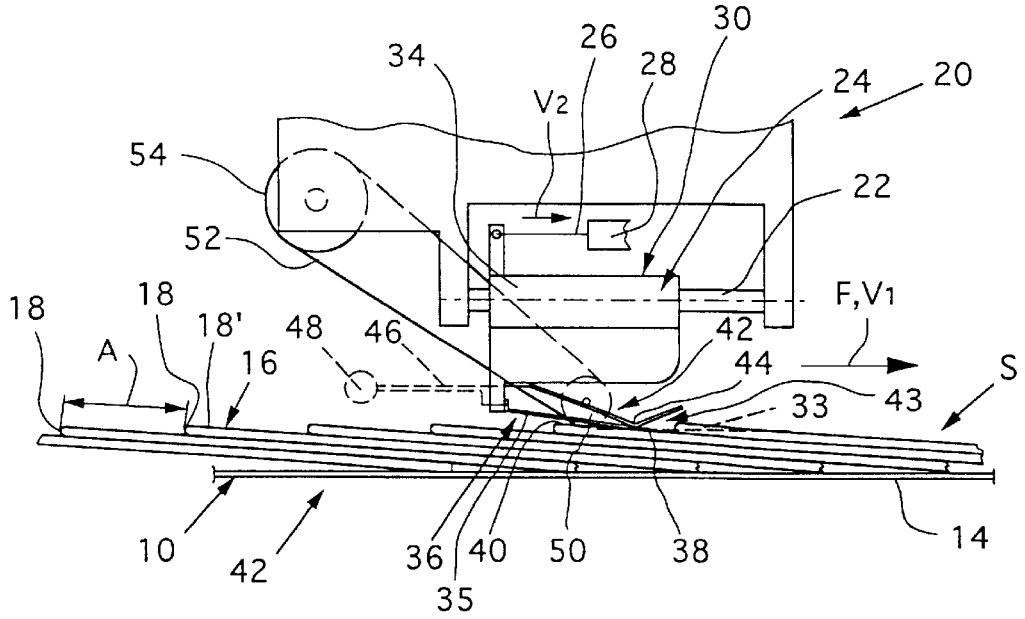
FIG. 1 shows, in elevation, a first embodiment of an apparatus according to the invention, the detection device being located in an upstream end position.
Figure 2:
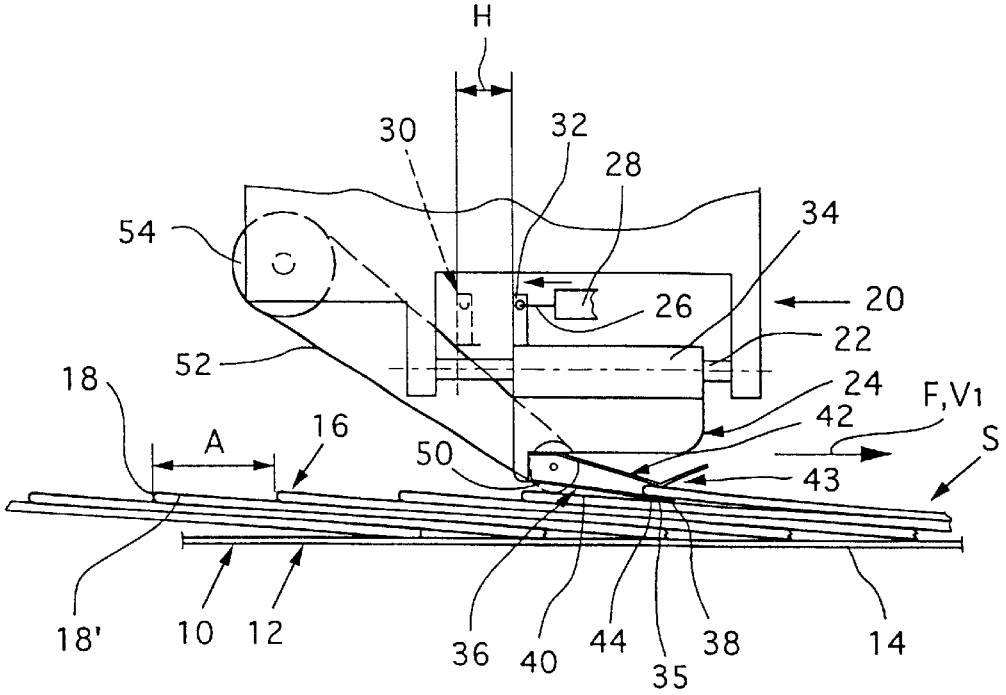
FIG. 2 shows, in the same illustration as FIG. 1, the embodiment shown there, the detection device being located in a downstream end position.

The apparatus shown in FIGS. 1 and 2 has a conveying device 12 constructed as a belt conveyor 10. The active run 14 of the belt conveyor 10 is driven at a conveying speed $v_1$ in the conveying direction F. Arranged on the active run 14 are flexible flat objects 16, printed products in the present case, in an overlapping formation S, in which each object 16 rests on the one respectively following it, in such a way that the rear edge 18 of the objects 16 is exposed in the upward direction.

Arranged above the belt conveyor 10 is a counting device 20. It has a guide rail 22 which extends in the conveying direction F and on which a detection device 24 is guided in the manner of a slide. Said detection device is connected via a rod 26 to a drive 28 constructed as a cylinder/piston unit. This drive is intended to move the detection device 24 to and fro, at a frequency f, between an upstream initial position 30, indicated in FIG. 1 with continuous lines and in FIG. 2 with dash-dotted lines, and a downstream reversing position 32 shown in FIG. 2 with continuous lines. This frequency f is greater than the quotient of the conveying speed $v_1$ and a minimum distance A between the rear edges 18 of successive objects 16. In the example shown, the frequency f is between two and three times as high as this quotient, however it is preferably at least twice as high as this quotient.

The stroke, designated by H, of the detection device is approximately half the size of the minimum distance A between the rear edge 18 of successive objects 16. In any case, it is less than this distance A. In a region—the aim should be the largest possible region—of the movement path 33, defined by the guide 22 and the drive 28, of the detection device 24 between the initial position 30 and the reversing position 32, the detection device 24 is moved at a speed $v_2$ which is higher than the conveying speed $v_1$. Coordinating the speed $v_2$, the stroke H and the frequency f ensures that the detection device 24 catches up with and overtakes the rear edge 18 of each object 16 conveyed past the counting device 20 in the conveying direction F.

An insertion element 36, which is constructed like a tongue and forms an activation element 35, is fastened at one end to the slide 34 of the detection device 24, which slide is guided on the guide rail 22, and the opposite insertion end 38 is free and oriented in the conveying direction F. The insertion element 36 is formed from a thin elastic material, for example spring steel sheet, and rests with prestress on that flat side 40 of an object 16 which faces it.

A detection element 42, likewise constructed in a manner of a spring tongue, is also fastened at one of its ends to the slide 34. In the free end region, the detection element 42 is bent over in the direction away from the conveying direction 12 and, in the absence of an object 16 between it and the insertion element 36, rests on the latter—forming a counting barrier 43—in the region of the bent-over section. The insertion element 36 and the detection element 42 thus form contact pieces of an electric contact arrangement 44 and are connected via electric leads 46 to a counter 48. The bent-over end region of the detection element 42 and the insertion end 38 of the insertion element 36, said end projecting beyond the point of contact with the detection element 42, form an inlet, widening in the conveying direction F, for the objects 16.

In FIG. 1, there is no object 16 located in the counting barrier 43 formed by the insertion element 38 and detection element 42, as a result of which the contact arrangement 46 and thus the electrical circuit are closed. In FIG. 2, the rear end region 18' of an object 16 is located in the counting barrier 43, as a result of which the contact arrangement 44 is opened by the object 16 itself, and the thus the electric circuit is interrupted.

During the uninterrupted to-and-fro movement of the detection device 24, the insertion element 36 in each case slides to-and-fro on the side face 40 of an object 16 until, because of the conveyance of the objects 16 and movement of the detection device 24, the latter passes behind the rear edge 18 of the object 16 and therefore, because of its prestress, comes to rest on the side face 40 of the next object 16. During the next stroke in the conveying direction F, the insertion element 36 is inserted, with its insertion end 38 in front, between this object and the immediately preceding object 16. During or following the insertion, the detection element 42 is moved out of contact with the insertion element 36 by the object 16 itself, in that the object 16—because of the relative movement between it and the detection device 24—runs in between the insertion element 36 and to the detection element 42. In the process, because of the inlet, the rear edge 18 of the objects 16 is treated carefully and an extremely small force which acts in the conveying direction F is exerted on the objects 16; this is because the force for lifting the detection element 42 off the insertion element 36 can be kept extremely small.

For completeness, it should be mentioned that the stoke H, the frequency f and the speed $v_2$ are coordinated with the permissible minimum distance A and the conveying speed $v_1$ in such a way that, between the detection of two successive objects, the detection device 24 always executes at least one stroke in the conveying direction F without any object 16 opening the contact arrangement 44. In the counter 48, signals emitted during successive strokes are counted as a single signal in this case. This leads to extremely precise counting of the objects 16.

For completeness, it should be mentioned that the apparatus also has a reference roll 50 which is freely rotatably mounted and arranged in a fixed position in relation to the guide rail 22; around said reference roll 50 there runs an inlet tape 52, which is also led around a roll 54 located upstream in relation to the reference roll 50 and further away from the conveying device 12. In the region of the reference roll 50 which faces the conveying direction 12, the inlet tape 52 forms a reference, for the overlapping formation S, which is coordinated with the insertion element 36. Said formation is conveyed by means of the conveying device 12 in such a way that the rear end region 18' of the objects 16 comes into contact with the reference.

Figure 3:
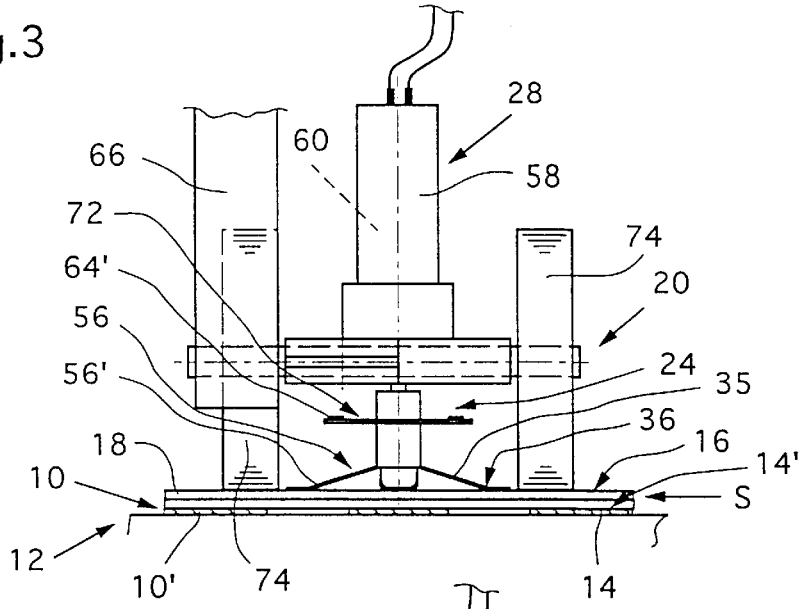
FIG. 3 shows, in a side view, a second embodiment of the apparatus according to the invention, with a rotationally driven insertion element and a light sensor arranged in a fixed position.
Figure 4:
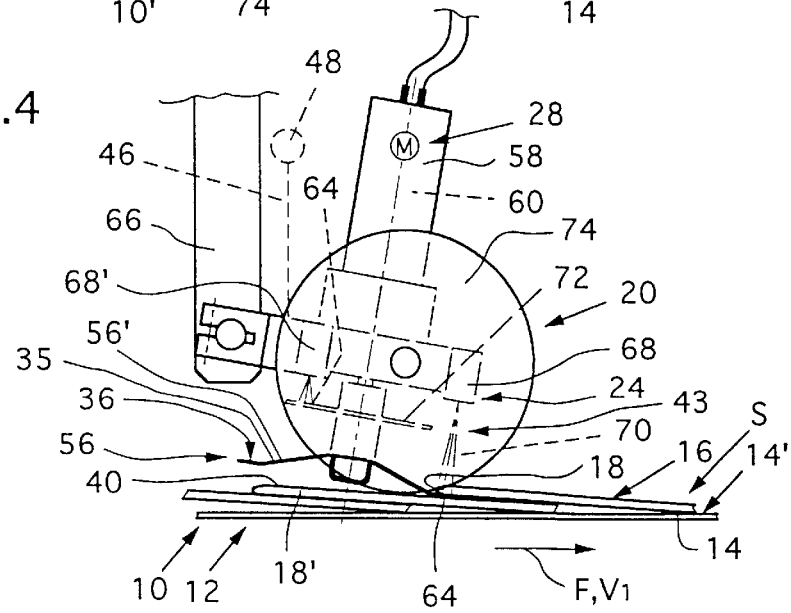
FIG. 4 shows, in elevation, the embodiment shown in FIG. 3 of the apparatus according to the invention.
Figure 5:
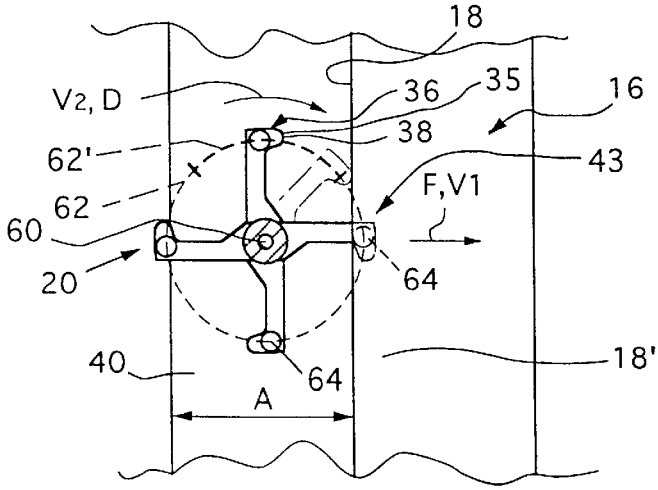
FIG. 5 shows, in plan view, the embodiment shown in FIGS. 3 and 4 of the apparatus according to the invention.

In the embodiments shown in FIGS. 3 to 5, the conveying device 12 is likewise formed by a belt conveyor 10, which has a number of conveying tapes 10' arranged beside one another. The active run 14 of these conveying tapes 10' defines a conveying plane 14' for the objects 16 arranged in an overlapping formation S. Here, to, each objects rests on the one following.

Once again, the counting device 20 is arranged above the conveying device 12. The detection device 24 of the counting device 20 has a paddle wheel 56, which is driven in rotation about its axis 60 by means of a drive 28 constructed as an electric motor 58. This axis 60 lies in a plane extending at right angles to the conveying plane 14' and in the conveying direction F, and is inclined forward in the conveying direction F. This inclination is preferably of such a magnitude that the angle—measured downstream of the axis 60—between the axis 60 and the objects 16 arranged in an overlapping formation F is an acute angle.

Arranged at each radial end of the four paddles 56' of paddle wheel 56 is a tongue-like insertion element 36, which projects forward from the paddles 56' in the direction of rotation D of the paddle wheel 56. The insertion ends 38 of the insertion elements 36 are thus moved along a circular movement path 62. One section 62' of this movement path 62 therefore extends approximately in the conveying direction F.

The rotation speed of the paddle wheel 56 is chosen such that, in the time defined by the quotient of the minimum distance A between the rear edge 18 of successive objects 16 and the conveying speed $v_1$, the paddle wheel 56, which has four paddles, executes one half of a revolution, but preferably a complete revolution. The distance from the axis 60 to the insertion element 36 is chosen such that, at this rotational speed, the peripheral speed $v_2$ is higher than the conveying speed $v_1$. The oblique position of the axis 60 and the coordination between the rotation speed of the paddle wheel 56 and the length of the paddles 56', and the conveying speed $v_1$ and the minimum distance A between the rear edge 18 of successive objects 16, means that each object 16 conveyed past the counting device 20 is engaged underneath at least once, but preferably more than once, by an insertion element 36. In order to avoid conflict between the paddle wheel 56 and the objects 16, the position of the paddle wheel 56 is chosen such that the insertion elements 36 come into contact with that flat side 40 of the relevant object 16 which faces them downstream of the point of intersection of the axis 60 with the conveying plane 14'. It should be mentioned that the paddle wheel 56 is made of a material having spring properties, for example spring steel, so that the paddles 56' rest on the flat side 40 with only a small force, but are reliably inserted between this object 16 and the preceding object.

In the radial end region, each paddle 56' has a reflector 64. A light-source/light-sensor unit 68 acting as a detection element is fastened to a frame 66, on which the electric motor 58 is also supported. Said unit is equally far removed from the axis 60 as the reflectors 64 and is arranged downstream of the axis 60 in the same plane, extending in the conveying direction F, as the axis 60. The light-source/light-sensor unit 68 emits a light beam 70 parallel to the axis 60 in the direction of the movement path 62, said light being reflected back to the light-source/light-sensor unit 68 when a vane 56' which is not covered by the end region 18' of an object 16 passes by. However, if a paddle 56' engages underneath an object 16, the light beam 70 is interrupted, as FIG. 4 shows, so that the detection device 24 is induced to emit a signal to the counter 48. The light-source/light-sensor unit 68 and the insertion element 36 in each case form a counting barrier 43.

In order to establish whether a paddle 56' not covered by an object 16 runs into or out of the light beam 70, and also to detect when a paddle 56' passes under the light beam 70 interrupted by an object 16, the counting device 20 has a reference disc 72, which rotates together with the paddle wheel 56 and is likewise provided with reflectors 64' at the same angular spacing as the paddles 56'. A second light-source/light-sensor unit 68' interacts with these reflectors 64', being fastened to the frame 66 diametrically opposite the light-source/light-sensor unit 68 but at a smaller distance from the axis 60. The further light-source/light-sensor unit 68' therefore emits a signal each time a paddle 56' is moved past the light-source/light-sensor unit 68. In the detection device 24, the signals from the two light-source/light-sensor units 68, 68' are compared with one another. Only if the two light-source/light sensor units 68, 68' generate a signal simultaneously is the light beam 70 not being interrupted by an object 16, and the insertion element 36 is not engaging underneath an object 16. On the other hand, if only the further light-source/light-sensor unit 68' emits a signal, this means that a paddle 56' is engaging underneath an object 16, and this object 16 is interrupting the light beam 70. Only then is a signal emitted to the counter 48.

The rotational speed of the paddle wheel 56 is preferably chosen such that at least one paddle 56' always reflects the light beam 70 before it is interrupted again by the next object 16, and such that during an interruption of the light beam 70, it is always the case that at least two paddles 56' are inserted between the object and the next object. This results in very precise counting with the possibility of simple evaluation of the signal.

On the frame 66, a reference wheel 74 is freely rotatably mounted on each of both sides of the detection device 24, on an axis running at right angles to the conveying direction F and parallel to the conveying plane 14'. The position of the reference wheel 74 in relation to the paddle wheel 56 is chosen such that the paddles 56' touch the flat side 40 of the object 16 resting on the reference wheel 74 at the desired point.

In order to count the objects, which are conveyed in overlapping formation in which each object rests on the preceding one, the counting device is arranged underneath the active run of the conveying device 12, the insertion element projecting beyond the active run 14. The function of the reference roll 40 and of the reference wheel 74 can then be performed by the active run.

If the objects 16, are, for example, folded printed products, whose fold leads and whose opening trails, it is also conceivable for the insertion element 36 to be inserted into the printed product on the open side.

The distance between the rear edges 18 of successive objects 16 may be different; however, it is never smaller, but usually larger, than the permissible minimum distance A. The movement of the insertion element 36 is not coordinated with the phase position or a system clock rate at which the objects effectively arrive. The apparatus is therefore suitable, in particular, even for counting objects which arrive in an irregular formation.

For the purpose of counting, both the signal at the entry of an object into the counting barrier and that at the exit of the object from the counting barrier can be evaluated.

It is of course also possible for the insertion element moved in translation (FIGS. 1 and 2) to be provided with a reflector, it being possible for a light-source/light-sensor unit to be arranged either on the slide 34 or in a stationary position at the downstream end of the movement path of the reflector.

What is claimed is:

1. An apparatus for counting flexible flat objects arranged in an overlapping formation, comprising a conveying device which is driven at a conveying speed in a conveying direction and so as to convey the objects, a detection device which includes an activation element which can be moved along a movement path which has at least one section extending at least approximately in the conveying direction, and a detection element which interacts with the activation element, and a drive which moves the activation element cyclically along said movement path and such that during at least its movement along said one section of its movement path the activation element moves at a higher speed than the conveying speed and is brought into interaction with a rear region of each object conveyed past the detection device, the detection device emitting a signal to a counter when the activation element interacts with the respective object, wherein the activation element is constructed as an insertion element which is inserted into the rear end region of the respective object or between the latter and the following object, and the detection element is arranged opposite the insertion element in order to form a counting barrier.

2. The apparatus as claimed in claim 1, wherein the insertion element is in the form of a tongue having a free insertion end and, when being inserted, is oriented with its free insertion end extending at least approximately in the conveying direction.

3. The apparatus as claimed in claim 1, wherein the insertion element and the detection element are contact pieces which rest on each other and are connected in electric circuit and can be separated from each other by the object in order to open the circuit and generate the signal.

4. The apparatus as claimed in claim 1, wherein the detection element is connected to the drive so as to move synchronously with the insertion element.

5. The apparatus as claimed in claim 1, wherein the detection element includes a light sensor and the insertion element has a reflection element to reflect a light beam toward the light sensor, and the detection element emits the signal when the light beam is interrupted by an object.

6. The apparatus as claimed in claim 5, wherein the detection element is arranged to be fixed and the movement path of the insertion element leads past it.

7. The apparatus as claimed in claim 5, wherein the activation element includes a paddle wheel which is driven in rotation about an axis which extends transversely with respect to a conveying plane for the objects defined by the conveying device, and the paddle wheel comprises a plurality of radial paddles, with each paddle being provided with an insertion element.

8. The apparatus as claimed in claim 1, wherein the frequency with which the insertion element is driven is at least twice as high as the quotient of the conveying speed and the minimum distance between the rear edges of successive objects, and the distance measured in the conveying direction in which the insertion element can be brought into engagement between two objects is less than the minimum distance between the rear edges of successive objects.

* * * * *